United States Patent [19]

Ishikawa et al.

[11] Patent Number: 5,073,466

[45] Date of Patent: Dec. 17, 1991

[54] ELECTROPHOTOGRAPHIC MEMBER CONTAINING A FLUORINE-CONTAINING LUBRICATING AGENT AND PROCESS FOR PRODUCING THE SAME

[75] Inventors: Fuminori Ishikawa, Hitachi; Kunihiro Tamahashi, Mito; Shigeharu Onuma; Masatoshi Wakagi, both of Hitachi; Masanobu Hanazono, Mito; Mitsuyoshi Shoji, Ibaraki; Takayuki Nakakawaji, Hitachi; Yutaka Ito, Takahagi; Shigeki Komatsuzaki, Mito; Yasuo Shimamura; Chiaki Yamagishi, both of Hitachi, all of Japan

[73] Assignees: Hitachi, Ltd.; Hitachi Chemical Company, Ltd., both of Tokyo, Japan

[21] Appl. No.: 394,657

[22] Filed: Aug. 16, 1989

[30] Foreign Application Priority Data

| | | | |
|---|---|---|---|
| Aug. 29, 1988 | [JP] | Japan | 63-212582 |
| Oct. 13, 1988 | [JP] | Japan | 63-255989 |
| Jan. 13, 1989 | [JP] | Japan | 1-4950 |

[51] Int. Cl.[5] ..... G03G 5/14

[52] U.S. Cl. ..... 430/66; 430/84; 430/96; 430/130; 355/212

[58] Field of Search ..... 430/85, 94, 66, 84, 430/96, 130; 428/331; 355/212

[56] References Cited

U.S. PATENT DOCUMENTS

| | | | |
|---|---|---|---|
| 4,423,132 | 12/1983 | Kondo et al. | 430/126 |
| 4,477,549 | 10/1984 | Fujimaki et al. | 430/126 |
| 4,659,621 | 4/1987 | Finn et al. | 430/99 |
| 4,863,809 | 9/1989 | Brar et al. | 428/653 |

*Primary Examiner*—John Goodrow

*Attorney, Agent, or Firm*—Antonelli, Terry, Stout & Kraus

[57] ABSTRACT

An electrophotographic member comprising a support, a photoconductive layer formed thereon, and a surface layer formed thereon, said surface layer including or attaching a lubricating agent having a perfluoropolyoxyalkyl or perfluoropolyoxyalkylene group to form an organic surface protective lubricating layer, and a fixing group to be fixed to the surface layer, is excellent in moisture resistance, wear resistance and cleaning properties and thus useful in an electrophotographic apparatus with a long life and high reliability.

29 Claims, 9 Drawing Sheets

ELECTROPHOTOGRAPHIC MEMBER CONTAINING A FLUORINE-CONTAINING LUBRICATING AGENT AND PROCESS FOR PRODUCING THE SAME

BACKGROUND OF THE INVENTION

This invention relates to an electrophotographic member, more particularly to an electrophotographic member with long life and high reliability, made from a hydrogenated amorphous silicon-containing material, and capable of forming good images without producing image blurring even if printed under high humidity after printed repeatedly, and a process for producing the same and an electrophotographic apparatus using the same.

As electrophotographic members, there have been used inorganic photoconductive materials such as Se, CdS, $As_2Se_3$, etc. and organic photoconductive materials such as phthalocyanine pigments. These materials are excellent in electrophotographic properties such as charge acceptance, photo response, photoconductivity, etc., but are disadvantageous in mechanical properties, e.g., low in hardness and poor in wear resistance. In contrast, since amorphous silicon photoreceptors are high in hardness and excellent in wear resistance, they are expected to be long-life electrophotographic members.

But, the amorphous silicon photoreceptors have a defect in that they are poor in moisture resistance. In order to improve moisture resistance, a surface protective layer made of a—SiC:H, a—SiN:H, etc. is generally provided. But, this is still insufficient.

In a printing process in electrophotography, since there is a charging process by corona discharge, the surface protective layer is oxidized and deteriorated in the moisture resistance by the repetition of printing process. In order to prevent the deterioration of moisture resistance, there are proposed to use as the surface protective layer an a—C:H:F film (Japanese Patent Unexamined Publication No. 63-191152) and thermoplastic resin films (Japanese Patent Unexamined Publication Nos. 55-142352 and 55-70848). But according to these surface protective layers, there is a problem in that both the moisture resistance and other properties required for surface protective layers of electrophotographic members, i.e. wear resistance and cleaning properties, are not always satisfied. Particularly in the case of using fluorine-containing materials as the surface protective layer, the moisture resistance is improved remarkably, but the wear resistance and cleaning properties are remarkably lowered.

On one hand, Japanese Patent Unexamined Publication No. 55-7762 discloses to include a perfluoroalkenyl group-containing compound in at least one layer constituting an electrophotographic member. Japanese Patent Unexamined Publication Nos. 56-51754, 58-23031 and 58-102949 disclose electrophotographic members and electrostatic image acceptors containing a solvent-insoluble polytetrafluoroethylene powder, e.g. a particle size of 20 μm or less, as a fluorine-containing compound in a surface layer.

On the other hand, Japanese Patent Unexamined Publication Nos. 58-23031, 58-102949, 61-205950 and 62-206559 disclose electrophotographic members and electrostatic image acceptors including perfluoroalkyl group-containing surface active agents or silane coupling agents as fluorine-containing compounds in a surface layer. In this case, the perfluoroalkyl group is represented by the formula: $C_nF_{2n+1}$—, wherein n is about 20 at most, limiting the length of fluorine chain. Thus, hydrophobic property may be improved due to exposed fluorine chain on the surface, but effects for reducing the coefficient of friction and improving lubricating properties are not so much, which results in making electrophotographic members poor in wear resistance and cleaning properties even if these fluorine-containing materials are included therein.

Further, in the case of including a polytetrafluoroethlyene powder, since the polytetrafluoroethylene is poor in affinity for other resins and is easily released, there is a problem of being poor in wear resistance.

As mentioned above, prior art techniques are insufficient in satisfying all the properties, that is, moisture resistance, wear resistance and cleaning properties, required for the surface protective layer of electrophotographic member, and have problems in that defects of a—Si:H photoreceptor are not overcome sufficiently, e.g. image blurring occurs after repetition of printing process, particularly under high humidity.

SUMMARY OF THE INVENTION

It is an object of the present invention to provide an electrophotographic member excellent in moisture resistance, particularly after repetition of corona charging, as well as excellent in wear resistance and cleaning properties, and having a surface protective layer, if necessary, and made from a hydrogenated amorphous silicon-containing material (e.g. a—Si:H).

The present invention provides an electrophotographic member comprising a support, a photoconductive layer made of a hydrogenated amorphous silicon-containing material formed on the support, and a surface layer formed on the photoconductive layer, said surface layer comprising a lubricating agent having a perfluoropolyoxyalkyl group or a perfluoropolyoxyalkylene group to form an organic surface protective lubricating layer and a fixing group for fixing the lubricating agent to the surface layer.

The present invention also provides a process for producing such an electrophotographic member and an electrophotographic apparatus using such an electrophotographic member.

DESCRIPTION OF THE PREFERRED EMBODIMENTS

The electrophotographic member of the present invention comprises a support, a photoconductive layer made of a hydrogenated amorphous silicon-containing material formed on the support, and a hydrophobic surface layer formed on the photoconductive layer, said surface layer including a lubricating agent having a perfluoropolyoxyalkyl or perfluoropolyoxyalkylene group to form an organic surface protective lubricating layer and a fixing group for fixing the lubricating agent to the surface layer.

Figure 1A:
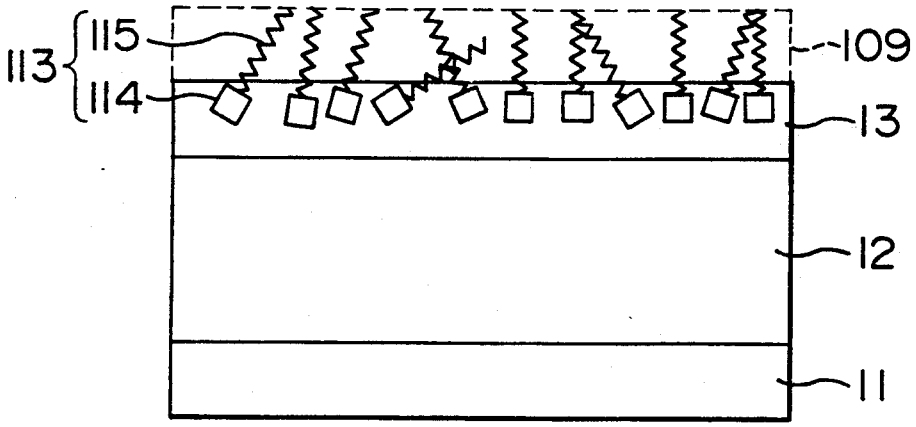
FIGS. 1(A) to 1(C) are cross-sectional views of essential portions of examples of electrophotographic members of the present invention.
Figure 1B:
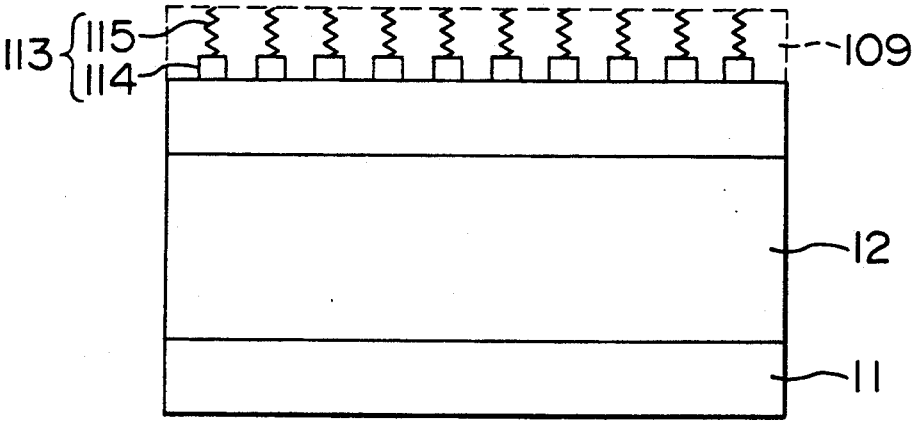
Figure 1C:
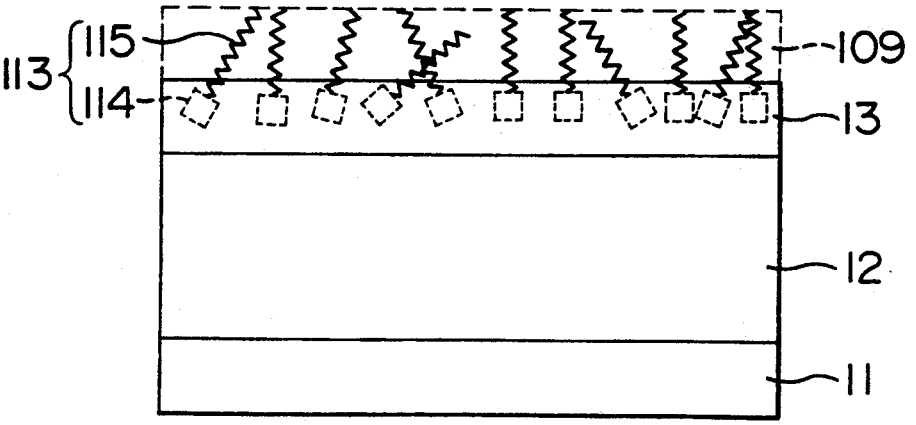

The fundamental structure of the electrophotographic member of the present invention is explained referring to FIGS. 1(A) to 1(C). In FIGS. 1(A) to 1(C), numeral 11 denotes a support, numeral 12 a photoconductive layer containing hydrogenated amorphous silicon (a—Si:H) at a surface portion, numeral 13 a surface layer, numeral 113 a lubricating agent, numeral 115 a perfluoropolyoxyalkyl or perfluoropolyoxyalkylene group (hereinafter referred to as "$R_f$ group"), numeral 114 a fixing group for fixing the lubricating agent to the surface layer (e.g. non-fluorine-containing group), and 109 an organic surface protective lubricating layer formed by the $R_f$ group.

FIG. 1(A) shows an example wherein the fixing group (114) of the lubricating agent (113) is a non-reactive group. On the surface of the photoconductive layer made of a—Si:H, a surface layer 13 (i.e. an organic polymer binder layer) is formed. Further, an organic surface protective lubricating layer 109 constructed by the $R_f$ group is formed on the surface layer (13). The surface layer (or binder layer) includes the lubricating agent (113) having the $R_f$ group and the fixing group (non-fluorine-containing group), the $R_f$ group being exposed on the surface of the binder layer (13) to form the organic surface protective lubricating layer (109). Further, since the non-fluorine-containing group of the lubricating agent is embedded in the binder layer (13) and fixed thereto, the resulting electrophotographic member is excellent in moisture resistance after corona charging, wear resistance and cleaning properties.

FIG. 1(B) shows an example wherein the fixing group (114) of the lubricating agent (113) is a reactive group, which is directly fixed to the surface layer. In this case, the lubricating agent forms the surface layer and directly fixes the fixing group to the a—Si:H layer of the photoconductive layer (12).

FIG. 1(C) shows an example wherein the fixing group (114) of the lubricating agent (113) is a reactive group, which is fixed in the surface layer (13) by reacting with a resin component (binder) in the surface layer (13).

The lubricating agent used in the present invention is a fluorine-containing lubricating agent having a long fluorine chain with 20 or more carbon atoms as the $R_f$ group, so that the coefficient of friction is lowered and the lubricating properties are remarkably improved. Further, since the fixing group bonding to the $R_f$ group has high affinity or bonding strength to the resin (binder, etc.), there is no defect of release of the lubricating agent.

As the lubricating agent having a non-reactive group as the fixing group, there can be used compounds represented by the formula:

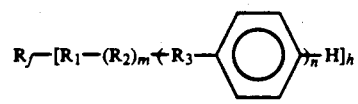

(I)

wherein $R_f$ is a perfluoropolyoxyalkyl group or a perfluoropolyoxyalkylene group; $R_1$ is a direct link, —$CH_2$—, —CO— or —CONH—; $R_2$ is an oxyalkylene group having 2 or 3 carbon atoms; $R_3$ is a direct link, —O—, —COO—, —CONH—, —NHCO—, —$OC_pH_{2p}$— (in which p is an integer of 1 or 2), or —$C(CH_3)_2$—, $R_3$ being able to be different ones depending on repetition; m is zero or an integer of 1 or more, preferably 1; n is an integer of 1 or more, preferably 4 to 10; and h is an integer of 1 or 2.

In this case, the fixing group is a non-fluorine-containing group of the formula:

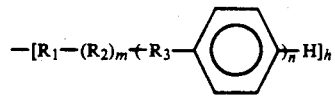

Examples of the perfluoropolyoxyalkyl group ($R_f$) are:

$F(C_3F_6—O—)_x—C_2F_4—$, or $F(C_3F_6—O—)_x—(CF_2O)_7—(CH_2)_z—$

Examples of the perfluoropolyoxyalkylene group ($R_f$) are:

$—(C_2F_4—O)_y—(CF_2O)_z—CF_2—$ (Both sides of $R_f$ are linked to non-fluorine-containing groups mentioned above).

In the above formulae as to the $R_f$ group, x is an integer of 1 or more, preferably 5 to 50; y is an integer of 1 or more, preferably 10 to 25; and z is an integer of 1 or more, preferably 10 to 56.

These fluorine-containing compounds are available commercially, e.g. Krytox 143 (a trade name, mfd. by E. I. du Pont de Nemours & Co.), Fomblin Y, Foblin z (trade names, mfd. by Monteflous/Montedison Group).

Concrete examples of the lubricating agent are as follows.

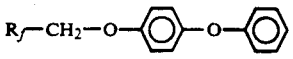

-continued

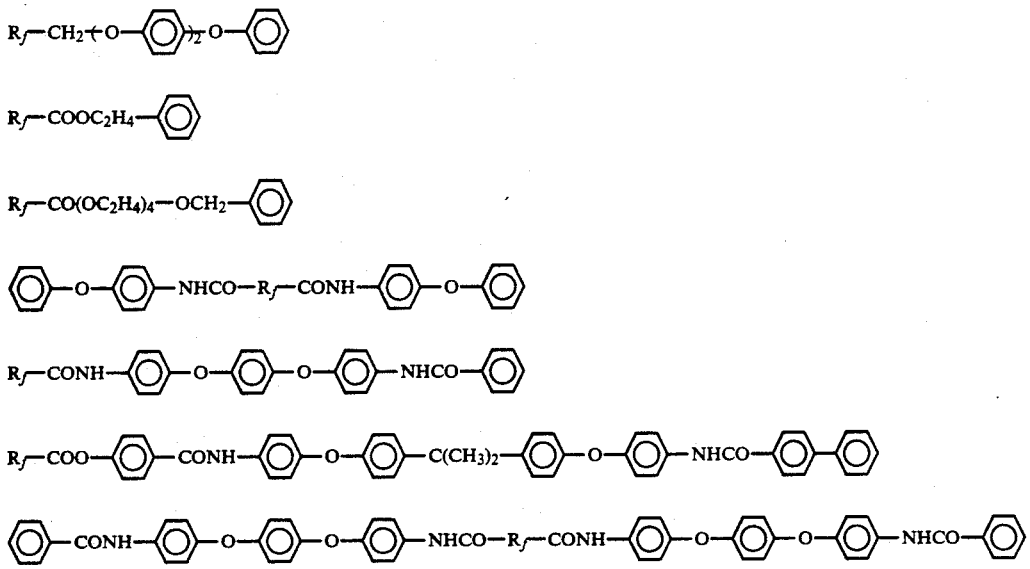

($R_f$: as defined above)

The organic polymer binder used in the surface layer (13) is not limited particularly, but is required to be at least partially crosslinked after curing. In the case of the a—Si:H photoreceptor, too high curing temperature may release hydrogen in the photosensitive layer to lower electrophotographic properties such as photoconductivity. Thus, it is preferable to use binders which can be cured at 300° C. or lower, preferably 250° C. or lower.

Examples of such organic polymer binders are thermosetting resins and thermoplastic resins, e.g. epoxy series resins, phenolic resins, melamine resins, polyurethane resins, polyimide resins, polyamide resins, polyester resins, polyetheramide resins, polyvinylidene chloride resins, etc.

The surface (or binder) layer (13) and the organic surface protective lubricating layer (109) can be formed, for example, as follows.

A lubricating agent of the formula (I), a three-dimensionally curable binder or thermoplastic resin binder are dissolved in an organic solvent. Examples of the organic solvent are a mixed solvent of methyl ethyl ketone, butyl acetate Cellosolve, and flon solvent, etc.

The resulting coating solution is coated on the surface of a photoconductive layer which is formed on a support by a conventional method such as a plasma CVD method or sputtering. As the coating method of the coating solution, there can be used a dipping method, a spin coating method, or the like. Then, the solvent is evaporated by heat treating at 80° to 120° C. for preferably 0.5 hour to 2 hours. At this stage, the $R_f$ group of the lubricating agent selectively deposits on the surface of the resulting binder layer (13) due to a small affinity to the binder to form an organic surface protective lubricating layer, while the non-fluorine-containing group is embedded in the binder layer (13) and fixed thereto. By conducting a successive heat treatment preferably at 180° to 300° C. for 1 to 3 hours, crosslinking of the binder layer is accelerated so as to fix the non-fluorine-containing group stronger to the binder layer and to complete the forming of the organic surface protective lubricating layer.

At this state, the surface of the electrophotographic member is partly covered by the fluorine and partly exposed in the form of binder layer as it is. When printing is repeated and corona charging is repeated, the exposing binder layer surface is probably easily damaged selectively. In order to prevent the binder layer surface from damage, it is preferable to subject the exposing binder layer surface to a plasma fluorinating treating so as to increase a fluorine covering rate.

The plasma fluorinating treatment can be carried out as follows. The resulting electrophotographic member (e.g. a drum) having the surface (binder) layer and the organic surface protective lubricating layer obtained by the heat treatment mentioned above is placed in a vacuum reactor having a support (or substrate) holder around which is positioned electrodes. The air in the reactor is removed to obtain a vacuum of $10^{-5}$ Torr. A fluorocarbon gas is introduced into the vacuum reactor. In this case, an inert gas such as Ar, He, or the like may be introduced theretogether. After introduction of the gas or gases, the pressure of the reactor is maintained at $10^{-3}$ to 10 Torr. Then, an electric power is applied to the electrodes to generate plasma to decompose the gas and to fluorinate the binder layer surface. As the electric power, there can be used a direct current electric source, high-frequency electric source, or the like. In this case, an electric power of 1 to 1000 W can be used.

When the fluorinating treating time becomes longer, the fluorination proceeds more. But since too long fluorinating treatment makes the binder layer disappear by etching, the period of 10 minutes or less is preferable.

A total thickness of the surface (or binder) layer and the organic surface protective lubricating layer is preferably 0.01 to 1 μm, more preferably 0.1 to 0.6 μm, since too large thickness worsens residual properties of electrophotographic member. When the thickness is 1 μm or less, there is no influence on photoconductivity and charging properties, even if the organic polymer binder layer is formed. The thickness of the plasma fluorinating treated layer is preferably 1 to 50 nm, more preferably 1 to 10 nm.

As mentioned above, the surface layer (or surface protective layer) is formed by coating a coating composition including a lubricating agent of the formula (I) on the photoconductive layer. The $R_f$ group is deposited on the surface layer to form the organic surface protective lubricating layer, while the non-fluorine-containing group as the fixing group is buried in the surface layer (or binder layer) to be fixed thereto. The concentration of the $R_f$ group deposited on the surface changes depending on the binder concentration in the coating composition or the lubricating agent concentration. Under the best conditions, the fluorine covering rate and the fluorine surface strength (as a result of fluorine intencity analysis by XPS (X-ray photoelectron spectroscopy) become the same as those of polytetrafluroo-ethylene. Thus, the resulting electrophotographic member is improved remarkably in the moisture resistance, wear resistance due to lowering in the coefficient of friction, and cleaning properties, while making the life longer.

In the case of subjecting the electrophotographic member to the plasma fluorinating treatment after the heat treatment, since the exposed portions of the binder layer surface under the organic surface protective lubricating layer are fluorinated, damages of the surface layer (or binder layer) suffered from repetition of corona charging during printing can be prevented.

Therefore, the resulting electrophotographic member is excellent in the wear resistance, clearing properties and corona resistance.

The photoconductive layer can be formed by, for example, a plasma CVD method, a photo CVD method, a reactive vacuum evaporation method or a sputtering method, followed by the formation of the surface layer.

As the lubricating agent having a reactive group as the fixing group and taking the structures as shown in FIGS. 1(B) and 1(C), there can be used compounds represented by the formula:

$$R_f\text{-}[R_4\text{—}R_5\text{—}Si(R_6)_q]_u \qquad \text{(II)}$$

wherein $R_f$ is as defined above; $R_4$ is —CONH—, —COO—, or —$CH_2O$—; $R_5$ is an alkylene group having 2 to 4 carbon atoms; $R_6$ is an oxyalkyl group having 1 to 3 carbon atoms; and q is an integer of 1 to 3 and u is an integer of 1 or 2. The fixing group, thus has a silanol group at the terminal.

Concrete examples of the compounds of the formula (II) are as follows.

$R_f$—CONH—$C_3H_6$—$Si(OC_2H_5)_3$
$R_f$—CONH—$C_3H_6$—$Si(OCH_3)_3$ $$R_f\text{—CONH—}C_3H_6\text{—}\overset{\overset{CH_3}{|}}{Si}(OCH_3)_2$$

$R_f$—COO—$C_3H_6$—$Si(OC_2H_5)_3$
$R_f$—$CH_2O$—$C_2H_4$—$Si(OCH_3)_3$
$Si(OC_2H_5)_3$—$C_3H_6$—NHCO—$R_f$—CONH—$C_3H_6$—$Si(OCH_3)_3$
($R_f$ = as defined above)

The terminal silanol group(s) of the compound of the formula (II) reacts with the inorganic substance of the photoconductive layer surface to form an oxane bonding.

Therefore, the photoconductive layer can be formed on the support by a plasma CVD method, a sputtering method, a vacuum deposition method, or the like. The lubricating agent of the formula (II) can directly be bonded to the photoconductive layer surface.

The photoconductive layer surface can be made of a—Si:H, a—SiC:H, a—SiN:H, a—C:H, a—C:H:F, or the like.

It is also possible to form a surface (or organic surface protective) layer containing an organic polymer on the surface of the photoconductive layer made of a—Si:H or the like.

As the material for forming the organic surface protective layer, there can be used those which can be partly crosslinked after curing and can be cured at a temperature of 300° C. or less, preferably 250° C. or less.

Examples of such materials are phenol curing type epoxy resins, styrene resins, polyester resins, polyimide resins, polyamide resins, etc.

The lubricating agent of the formula (II) can be bonded to the surface of photoconductive layer made of a—Si:H or the like, or the organic surface protective layer formed on the photoconductive layer as follows.

A lubricating agent of the formula (II) is dissolved in a solvent such as a flon solvent, or a mixed solvent of a flon solvent and a general organic solvent such as methyl ethyl ketone, etc. The resulting coating solution is coated on the photoconductive layer by a dipping method, a spin coating method, or the like. The coated layer is, then, heat treated at preferably 100° C. to 200° C. for 0.5 to 2 hours. By this heat treatment, the terminal silanol group of the lubricating agent reacts with Si, C, N or the like on the photoconductive layer and is fixed thereto by forming the oxane bonding.

The lubricating agent of the formula (II) can also be contained in the organic surface protective layer formed on the photoconductive layer.

A lubricating agent of the formula (II) is dissolved in an organic solvent such as a flon solvent, methyl ethyl ketone, etc., to form a solution (I). Then, a three-dimensionally curing type binder or a thermoplastic binder is dissolved in an organic solvent such as a mixed solvent of methyl ethyl ketone and butyl acetate Cellosolved, to form a solution (II).

The solution (I) and the solution (II) are mixed to form a coating solution. The coating solution is coated on the photoconductive layer by a dipping method, a spin coating method, or the like.

The coated layer is subjected to a first-step heat treatment preferably at 80° to 150° C. for 0.5 to 3 hours, followed by a second-step heat treatment preferably at 180° to 300° C. for 1 to 3 hours. The first-step heat treatment is mainly aimed at the vaporization of the solvent, and the second-step heat treatment is mainly aimed at the crosslinking of the organic surface protective layer.

When the lubricating agent of the formula (II) is dispersed and contained in the organic surface protective layer, the thickness of the organic surface protective layer is preferably 1 μm or less, more preferably 0.1 to 0.6 μm. When the thickness is too large, residual properties of the electrophotographic member are undesirably worsened. When the thickness is 1 μm or less, there is no influence on the photoconductivity and charging properties, even if the organic surface protective layer is formed.

In the case of using an epoxy resin as the organic surface protective layer, the lubricating agent of the formula (II) having the terminal silanol group(s) can be replaced by a lubricating agent of the formula:

$$R_f\text{—}R\text{—}(R')_j\text{—}(NCO)_k \qquad \text{(III)}$$

or $$\{R_f\}-\{R-(R')_j-(NCO)_k\}_2 \quad \text{(IV)}$$

wherein $R_f$ is as defined above; R is —CONH—, —OCONH— or —$CH_2$OCONH—; R′ is a divalent or trivalent saturated aliphatic hydrocarbon group having 5 to 20 carbon atoms such as 4-methyl-octane:

$$-(CH_2)_3-\underset{\underset{CH_2-}{|}}{CH}-(CH_2)_4-,$$

etc., or a divalent or trivalent aromatic hydrocargon group such as

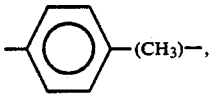

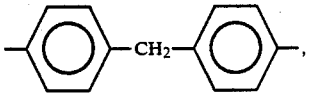

-continued

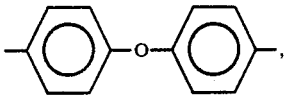

etc.; j is zero or an integer of 1 or more, preferably 1; and k is an integer of 1 or 2, or

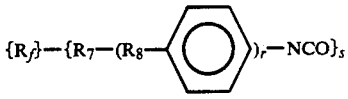

(V)

wherein $R_f$ is as defined above; $R_7$ is a direct link, an amido linkage, —$CH_2$— or —CO—; $R_8$ is a direct link, an ether linkage, an ester linkage, an amido linkage, or —$OC_kH_{2k}$—, $R_8$ being able to be different ones depending on repetition; r is an integer of 1 or more, preferably 1 to 3; and s and k are independently an integer of 1 or 2.

Examples of the lubricating agents of the formulae (III), (IV) and (V) are as follows.

$$R_f-CONH-CH_2-C(CH_3)_2-CH_2-CH(CH_3)-CH_2-CH_2-NCO$$

$$R_f-CONH-(CH_2)_3-\underset{\underset{CH_2-NCO}{|}}{CH}-(CH_2)_4-NCO$$

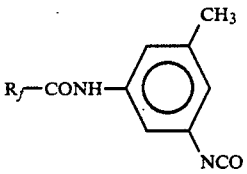

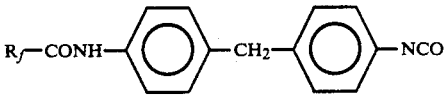

$$\{R_f\}-\{CONHCH_2C(CH_3)_2-CH_2CH(CH_3)CH_2CH_2-NCO\}_2$$

$$\{R_f\}-\{CONH-(CH_2)_3-\underset{\underset{CH_2-NCO}{|}}{CH}-(CH_2)_4-NCO\}_2$$

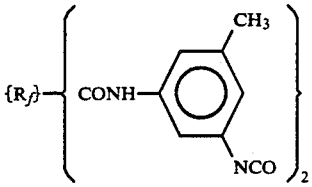

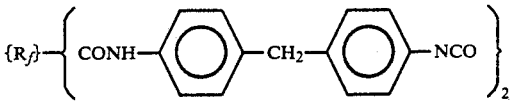

$$R_f-CH_2OCONH-CH_2C(CH_3)_2-CH_2CH(CH_3)-CH_2CH_2-NCO$$

$$R_f-CH_2-OCONH-(CH_2)_3-\underset{\underset{CH_2-NCO}{|}}{CH}-(CH_2)_4-NCO$$

-continued

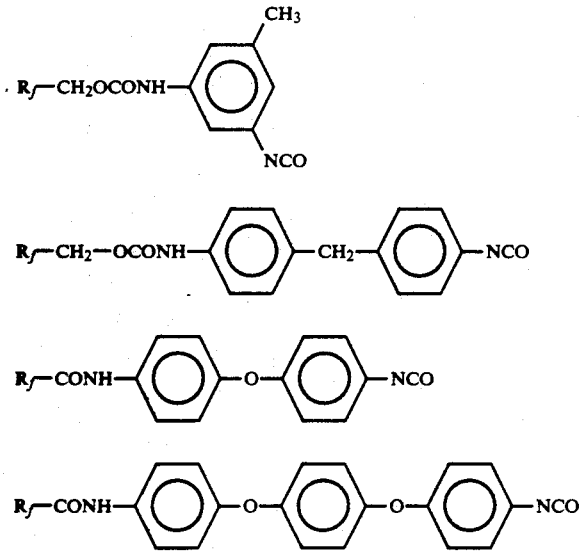

($R_f$=as defined above)

These isocyanate groups can be masked by a phenol such as phenol, cresol, or the like, a primary amine such as aniline

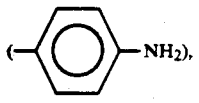

or an alcohol such as methanol, ethanol, etc., so that they can react after heating.

A surface layer containing a lubricating agent of the formula (III), (IV) or (V) can be formed as follows. A coating solution is prepared by dissolving a lubricating agent wherein the isocyanate group is masked and a curing agent such as a polyfunctional epoxy compound, a phenolic compound, an amine compound, a polyamide compound or the like are dissolved in an organic solvent.

As the organic solvent, there can be used methyl ethyl ketone, cyclohexanone, N,N-dimethylformamide, ethylene glycol methyl ether, etc., and a mixture thereof.

A photoreceptor is dipped in the coating solution to form a coating film, followed by heating to remove the masking group for the isocyanate group and to carry out the reaction with epoxy groups. Thus, the lubricating agent chemically bonds to the epoxy compound via oxazolidone rings. The heat treating conditions such as the heating temperature, the heating time, etc. mentioned above can also be used in this heat treatment.

As mentioned above, when the lubricating agent of the formula (II) having the $R_f$ group and the terminal silanol group is used, the terminal silanol group reacts with the surface portion of the a—Si:H photoreceptor to form a strong linkage and to be fixed to the surface of the photoreceptor.

On the other hand, when the lubricating agent of the formula (II) is contained in the organic surface protective layer formed on the photoconductive layer, the silanol group reacts with the organic surface protective layer. As a result, a part of the lubricating agent is fixed strongly in the organic surface protective layer and the rest of the lubricating agent is fixed to the surface of the photoconductive layer.

Since the $R_f$ group of the lubricating agent of the formula (II) covers the surface of electrophotographic member with long chains of fluorocarbon groups, excellent effects can be obtained in water-repellency, cleaning properties and wear resistance. Thus, when the lubricating agent of the formula (II) is applied to an electrophotographic member, high reliability without forming image blurring and long life of the electrophotographic member can be realized.

The same thing can be said when the lubricating agents of the formulae (III), (IV) and (V) containing isocyanate groups are used.

The photoconductive layer used in the electrophotographic member should be made of a hydrogenated amorphous silicon-containing material. Examples of such a material are so-called hydrogenated amorphous silicon; hydrogenated amorphous silicon alloys containing 20% by atom or less of one or more elements selected from carbon, nitrogen, oxygen, germanium, tin, aluminum and zinc; the amorphous silicon containing a trace amount of boron or phosphorus in the range of 0.1 to 10000 ppm; the amorphous silicon alloys containing a trace amount of boron or phosphorus in the range of 0.1 to 10000 ppm, etc.

The photoconductive layer may be a single layer such as a carrier generation and conductive layer or a plurality of layers comprising a carrier conductive layer and a carrier generation layer conventionally used as shown in FIGS. 2, 4, 6 and 7.

The photoconductive layer may be accompanied by a blocking layer, a protective layer, etc. as usual.

The support is usually made of an electroconductive material such as aluminum, stainless steel (SUS of Japanese standards), etc. The support can take various shapes such as a sheet, a plate, a drum, and the like.

Figure 10:
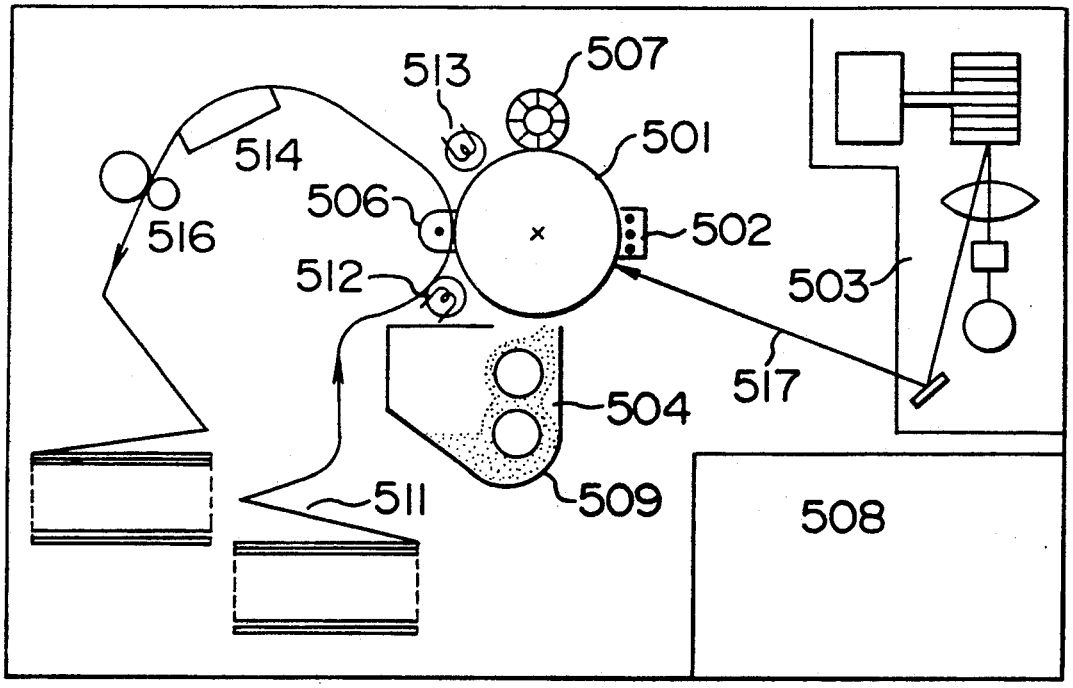
FIG. 10 is a schematic view of an electrophotographic apparatus using the electrophotographic member of the present invention.

In the present invention, there can be used an electrophotographic apparatus as shown in FIG. 10 wherein the electrophotographic member of the present invention is used.

Such an electrophotographic apparatus comprises a photoreceptor drum comprising a support and formed thereon a photoconductive layer made of a hydrogenated amorphous silicon-containing material, a charging system for charging said photoreceptor drum, an optical system for forming a latent image on said photoreceptor drum, a developing system for forming a printing pattern by adhering a toner to said photoreceptor drum forming the latent image, an image transferring system for transferring the printing pattern on said photoreceptor drum, and a cleaning system for removing excess toner remaining on said photoreceptor drum, the uppermost surface portion of said photoreceptor drum comprising a lubricating agent having a perfluoropolyoxyalkyl group or a perfluoropolyoxyalkylene group to form an organic surface protective lubricating layer and a fixing group for fixing the lubricating agent to the surface portion.

The lubricating agent can be that of the formula (I) or that of the formula (II) or formula (III), (IV) or (V) as explained above.

The present invention is illustrated by way of the following Examples, in which all percents are by weight unless otherwise specified.

EXAMPLE 1

Comparative Example 1

Figure 2:
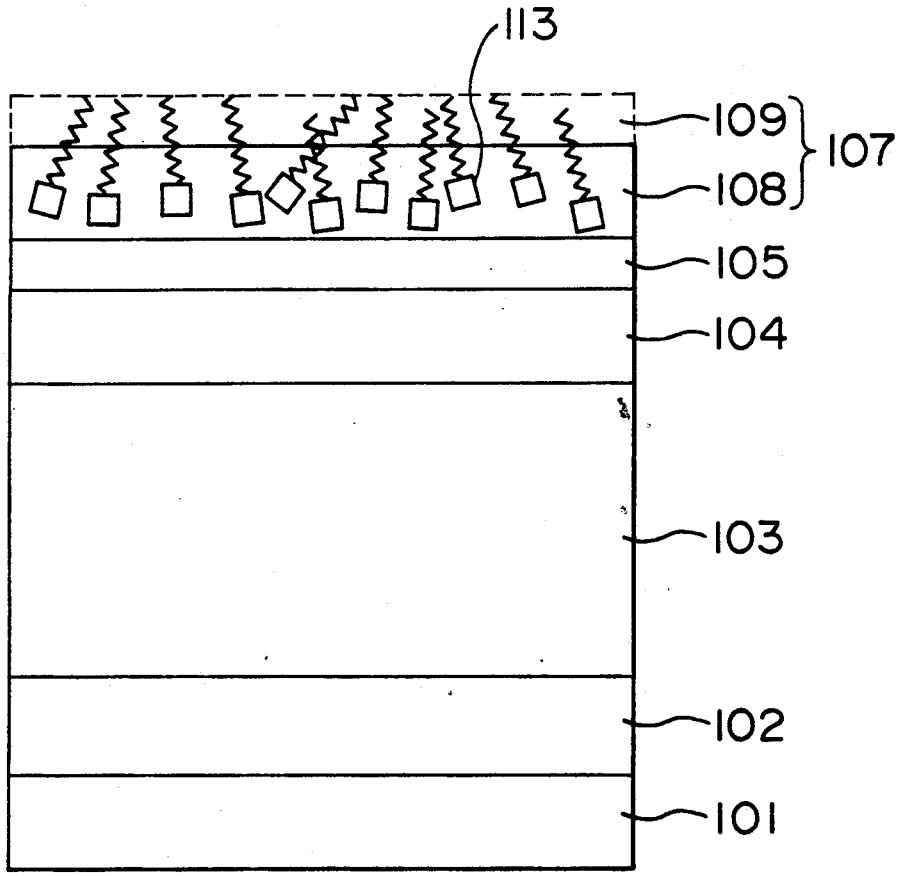
FIG. 2 is a cross-sectional view of an essential portion of one example of electrophotographic member of the present invention.

An electrophotographic member as shown in FIG. 2 was produced. In FIG. 2, numeral 101 denotes an aluminum drum, numeral 102 a blocking layer, numeral 103 a change transport layer (or carrier conductive layer), numeral 104 a charge generating layer (or carrier generation layer), numeral 105 a surface protective layer, numeral 113 a lubricating agent, numeral 107 an organic surface protective layer, numeral 108 an organic binder layer, and numeral 109 an organic surface protective lubricating layer.

On the aluminum drum 101 of 120 mm in diameter and 400 mm in length, the blocking layer 102 of a—SiC:H:B was formed by using mixed gases of monosilane, ethylene, diborane and hydrogen. The carrier conductive layer 103 of a—Si:H:B was formed on the blocking layer by using mixed gases of monosilane, diborane and hydrogen. The carrier generation layer 104 of a—SiGe:H was formed on the carrier conductive layer by using mixed gases of monosilane, germanium and hydrogen. Then, the surface protective layer 105 of a—SiC:H was formed on the carrier generation layer by using mixed gases of monosilane, ethylene and hydrogen. These layers were formed successively in a plasma gas phase reaction apparatus wherein high-frequency of 13.56 MHz was applied. Thicknesses of these layers were as follows: the blocking layer 2 μm, the carrier conductive layer 30 μm, the carrier generation layer 1 μm, and the surface protective layer 0.5 μm.

The resulting photosensitive element was taken out of the plasma gas phase reaction apparatus and subjected to coating of the organic surface protective layer 107. A coating solution was prepared by mixing a mixed solvent of 1035 g of methyl ethyl ketone, 150 g of acetate ethylene glycol mono-n-butyl ether, and 75 g of flon solvent with 91.2 g of an epoxy resin (XD 9053, mfd. by Dow Chemical Co.), 148.8 g of phenol resin (Resin M, mfd. by Cosmo Oil) and 0.91 of triethylammonium tetraphenyl borate, followed by mixing with 6 g of a lubricating agent 113 of the formula:

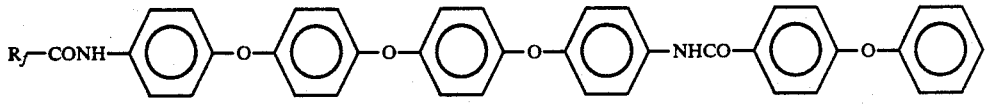

wherein $R_f$ is $F[CF(CF_3)—CF_2O—]_n—CF(CF_3)—$; and n is 14 in average.

In the coating solution, the above-mentioned a—Si:H photosensitive element was immersed to form an organic binder film on the surface, followed by a first-step heat treatment at 100° C. for 1 hour and a second-step heat treatment (curing of the binder with heating) at 200° C. for 2 hours to complete the formation of the organic surface protective layer 107.

By the heating after film formation, individual perfluroopolyoxyalkyl groups of the lubricating agent were orientedly deposited on the surface of the organic binder layer 108 to form the organic surface protective lubricating layer 109, while the non-fluorine-containing group as the fixing group of the lubricating agent is embedded in the organic binder layer 108 to be fixed thereto. The thickness of the organic surface protective layer was 0.3 μm.

The thus obtained electrophotographic member was placed in an electrophotographic properties tester to carry out a corona charging test while allowing the electrophotographic member to stand. The moisture resistance after the corona charging test was evaluated by the contact angle of water. The results are shown in FIG. 3, which is a graph showing a relationship between the exposure time to corona charging (hours) and the contact angle of water (degree).

Figure 3:
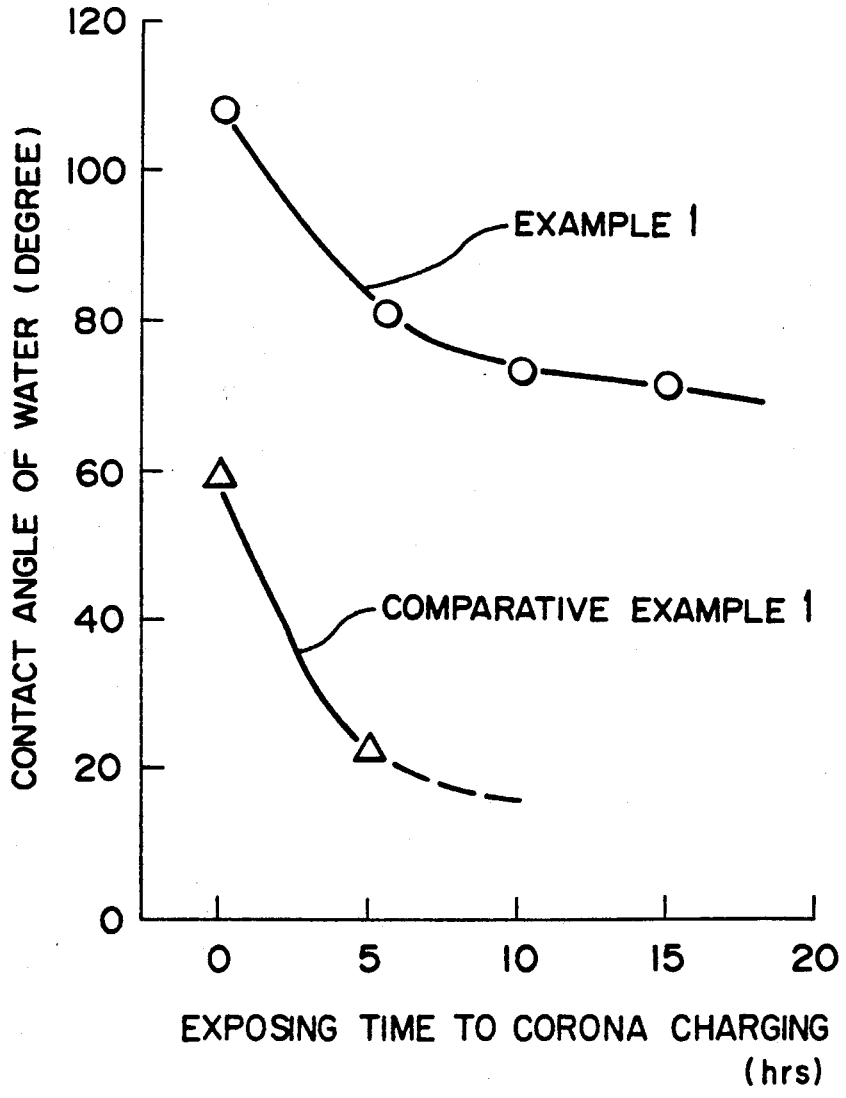
FIG. 3 is a graph showing a change of contact angle of water depending on exposure time to corona charging.

For comparison, the results of an electrophotographic member having no organic surface protective layer 107 (Comparative Example 1) are also shown in FIG. 3.

As is clear from FIG. 3, the electrophotographic member of the present invention shows high contact angle values even after 15 hours' corona charging, indicating that the moisture resistance is good.

Using the electrophotographic member after the corona charging, a printing test was carried out. No image blurring under the humidity of 80% RH was observed and a good image was obtained.

A continuous printing test was carried out using the a—Si:H electrophotographic member with a printer placed in a constant-temperature constant-humidity room adjusted at 20° C. and 80% RH (relative humidity). No filming was produced after printings 1,500,000 pages of paper and initial good image was maintained.

EXAMPLE 2

After forming an a—Si:H film of 2 μm thick and an a—SiC:H film of 0.5 μm thick by a plasma CVD method on an aluminum alloy disc of 3.5 inches in diameter, the same organic polymer surface protective layer as used in Example 1 was formed in the same manner as described in Example 1.

Sliding durability of the resulting disc was evaluated using a spherical surface sliding tester. That is, a load of 2 g was applied to a sapphire spherical slider (R 30) and the disc was revolved at a peripheral speed of 4 m/sec, a temperature of 25° C. and humidity of 50% RH or less. The sliding durability was evaluated by the total number of revolutions until the film was broken.

The results are shown in Table 1.

COMPARATIVE EXAMPLES 2 to 4

The process of Example 2 was repeated except for using 6 g of a fluorine compound of the formula:

$$C_8F_{17}SO_2{\cdot}N{\cdot}CH_3CH_2OCOOK$$

(Comparative Example 2), using 6 g of a fluorine-containing oligomer compound (Surflon S, a trade name, mfd. by Asahi Glass Co.) (Comparative Example 3), and using 30 g of polytetrafluoroethylene powder having a particle size of 0.3 μm, in place of the lubricating agent used in Example 1, respectively.

The sliding durability was evaluated in the same manner as described in Example 2 and listed in Table 1.

TABLE 1

| Example No. | Total number of revolution until film breakage |
|---|---|
| Example 2 | >200,000 |
| Comparative Example 2 | 2,000 |
| Comparative Example 3 | 2,000 |

TABLE 1-continued

| Example No. | Total number of revolution until film breakage |
|---|---|
| Example 3 | |
| Comparative Example 4 | 1,000 |

As is clear from Table 1, the sliding durability of the organic surface protective lubricating layer of Example 2 is by far excellent compared with those of Comparative Examples 2 to 4. This means that the organic surface protective lubricating layer of the present invention satisfies the required wear resistance as the surface protective layer sufficiently.

EXAMPLE 3 a—Si:H photosensitive elements and 3.5 inch discs having the four-layer structure of 102 to 105 as shown in FIG. 2, respectively, were prepared in the same manner as described in Examples 1 and 2. Then, organic surface protectives layers were formed using the same coating solution as used in Example 1 except for using lubricating agents as listed in Table 2 in place of the lubricating agent used in Example 1.

TABLE 2

| Run No. | Lubricating agent |
|---|---|
| 1 | 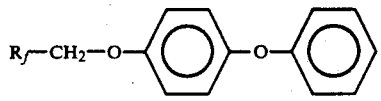 |
| 2 | 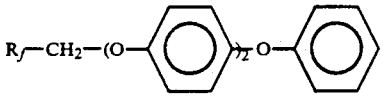 |
| 3 | 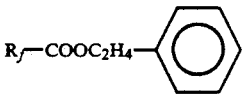 |
| 4 | 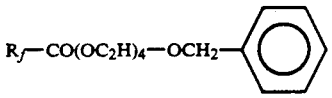 |
| 5 | 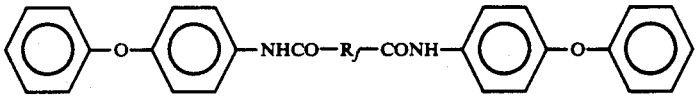 |
| 6 | 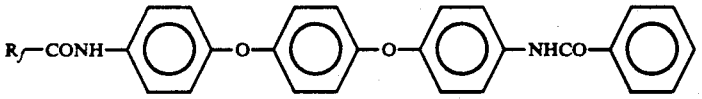 |
| 7 | 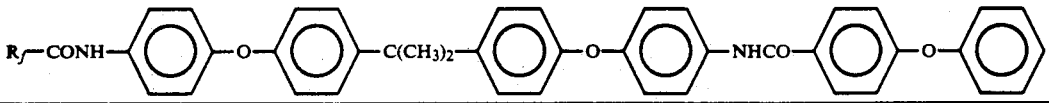 |

wherein $R_f$ is $F(CF(CF_3)—CF_2O—)_n—CF(CF_3)—$ (Run Nos. 1–4 and 6–7), $—F(C_3F_6—O—)_n—(C_2F_2O)_y—(CF_2)_z—$ or $—(C_2F_4O)_y—(CF_2O)_z—CF_2—$ (Run No. 5), n = 14 in average, y = 10–25, and z = 10–56.

The resulting electrophotographic members were subjected to the corona charging test in the same manner as described in Example 1 to evaluate the change of contact angle of water. The results were the same as those of Example 1.

Then, the sliding test was carried out as to the 3.5 inch discs in the same manner as described in Example 2. The results are shown in Table 3. As is clear from Table 3, the organic surface protective lubricating layers of Run Nos. 1 to 7 are good in the sliding durability.

TABLE 3

| Run No. | Total number of revolution until film breakage |
|---|---|
| 1 | 20000 |
| 2 | 5000 |
| 3 | 130000 |
| 4 | 40000 |
| 5 | 50000 |
| 6 | >200000 |
| 7 | 120000 |
| Comparative Example 2 | 2000 |

EXAMPLE 4

The process of Example 1 was repeated except for forming an a—SiN:H film, an a—C:H film, or an a—C:H:F film as the surface protective layer 105 in place of a—SiC:H layer, or not forming the surface protective layer 105.

The same results as obtained in Example 1 were obtained.

EXAMPLES 5 AND 6

Comparative Example 5

Figure 4:
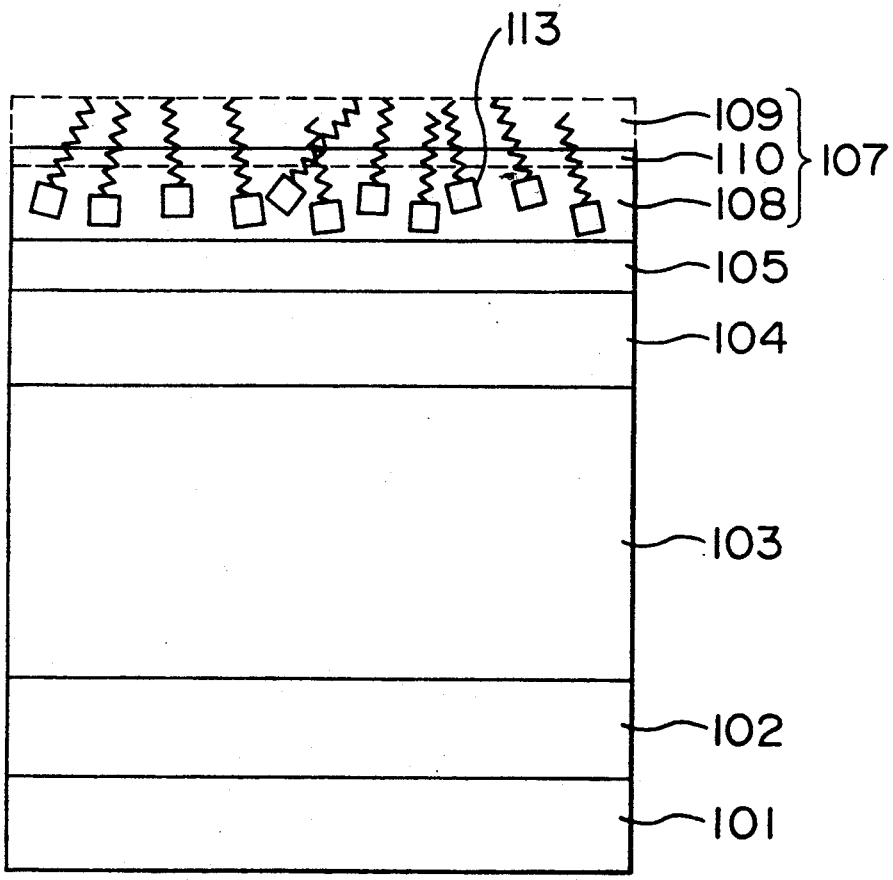
FIG. 4 is a cross-sectional view of an essential portion of one example of electrophotographic member of the present invention.

Electrophotographic members as shown in FIGS. 2 and 4 were produced. In FIGS. 2 and 4, numeral 101 denotes an aluminum drum, numeral 102 a blocking layer, numeral 103 a carrier conductive layer, numeral 104 a carrier generation layer, numeral 105 a surface protective layer, numeral 113 a lubricating agent, numeral 107 an organic surface protective layer, numeral 108 an organic binder layer, numeral 109 an organic surface protective lubricating layer, and numeral 110 a fluorinating treated layer.

On the aluminum drum 101 of 120 mm in diameter and 400 mm in length, the blocking layer 102 of a—SiC:H:B using mixed gases of monosilane, ethylene, diborane and hydrogen; the carrier conductive layer 103 of a—Si:H:B using mixed gases of monosilane, diborane and hydrogen; the carrier generation layer 104 of a—SiGe:H using mixed gases of monosilane, germanium and hydrogen; and the surface protective layer 105 of a—SiC:H using mixed gases of monosilane, ethylene and hydrogen, were formed successively in a plasma gas phase reaction apparatus wherein high-frequency of 13.56 MHz was applied. Thicknesses of these layers were as follows: the blocking layer 2 μm, the carrier conductive layer 30 μm, the carrier generation layer 1 μm and the surface protective layer 0.5 m.

The resulting photosensitive element was taken out of the plasma gas phase reaction apparatus and subjected to coating of the organic surface protective layer 107. A coating solution was prepared by mixing 91.2 g of an epoxy resin, 148.8 g of a phenol resin, and 0.9 g of triethylammonium tetraphenyl borate with a mixed solvent of 1035 g of methyl ethyl ketone, 150 g of acetate ethylene glycol mono-n-butyl ether and 75 g of flon solvent, followed by mixing with 6 g of a lubricating agent 113 of the formula:

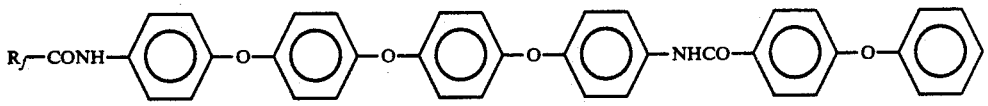

wherein $R_f$ is $F[CF(CF_3)—CF_2O]_n—CF(CF_3)—$; and n is 14 in average. In this coating solution, the a—Si:H photosensitive element was immersed to form an organic binder film on the surface, followed by a first-step heat treatment at 100° C. for 1 hour and a second-step heat treatment at 200° C. for 2 hours to complete the curing of the organic surface protective layer 107.

By the heating after film formation, individual perfluoropolyoxyalkyl groups of the lubricating agent were orientedly deposited on the surface of the organic binder layer 108 to form the organic surface protective lubricating layer 109, while the non-fluorine-containing group as the fixing group of the lubricating agent is buried in the organic binder layer 108 to be fixed thereto, as shown in FIG. 2 (Example 5).

An electrophotographic member obtained in the same manner as mentioned above was placed again in the plasma gas phase reaction apparatus. After removing the air to a vacuum of $5\times10^{-6}$ Torr, a perfluoroethane $C_2F_6$) gas in an amount of 40 sccm and He gas in an amount of 60 sccm were introduced into the plasma gas phase reaction apparatus to adjust the pressure at 0.5 Torr. Then, high-frequency of 13.56 MHz was applied to a 300 W electrode to generate plasma for conducting fluorinating treatment to form the fluorinating treated layer 110 (Example 6, FIG. 4). The treating time was 2 minutes.

The thus obtained electrophotographic members were placed in the electrophotographic properties tester to carry out the corona charging test, while allowing the electrophotographic members to stand. The moisture resistance after the corona charging test was evaluated by the contact angle of water. The results are shown in FIG. 5, which is a graph showing a relationship between the exposure time to corona charging (hours) and the contact angle of water (degree).

Figure 5:
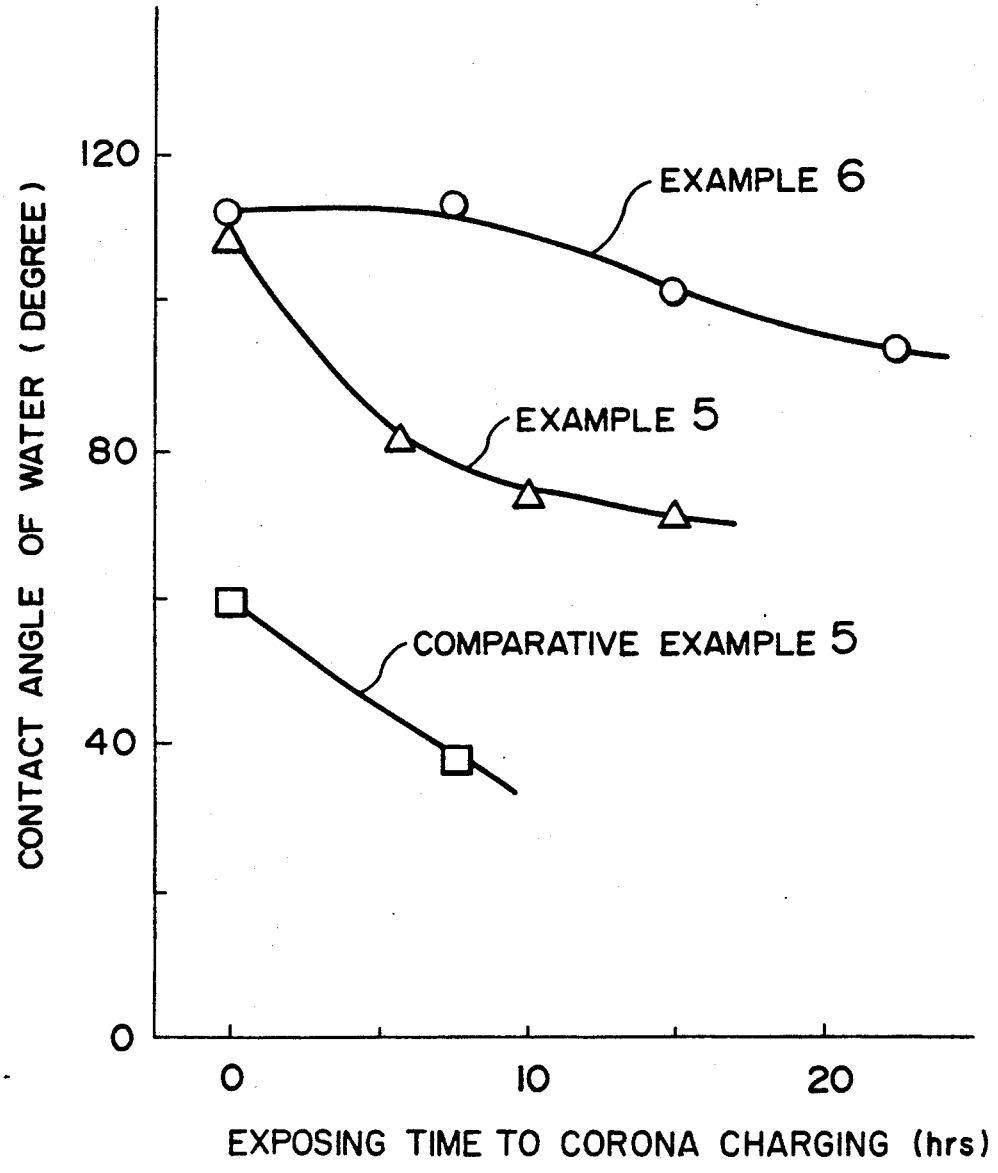
FIG. 5 is a graph showing a change of contact angle of water depending on exposure time to corona charging.

For comparison, the results of an electrophotographic member having no organic surface protective layer 107 (Comparative Example 5) are also shown in FIG. 5.

As is clear from FIG. 5, the electrophotographic members of the present invention show high contact angle values even after 15 hours' corona charging, indicating that the moisture resistance is good.

Using the electrophotographic members after the corona charging, the printing test was carried out. No image blurring under the humidity of 80% RH was observed and good images were obtained.

The continuous printing test was carried out using the electrophotographic members in the same manner as described in Example 1. No filming was produced after printing 1,500,000 pages of paper and initial good images were maintained.

EXAMPLES 7 AND 8

Comparative Example 6

After forming an a—Si:H film of 2 μm thick and an a—SiC:H film of 0.5 μm thick by a plasma CVD method on an aluminum alloy disc of 3.5 inches in diameter, the same organic polymer surface protective layer as used in Example 5 was formed in the same manner as described in Example 5 (Example 7).

An electrophotographic member obtained in the same manner as mentioned above was subjected to the plasma fluorinating treatment in the same manner as described in Example 6 (Example 8).

Sliding durability of the thus obtained discs were evaluated in the same manner as described in Example 2.

For comparison, a disc was produced similarly by forming a—Si:H/a—SiC:H films, but not forming the organic surface protective layer (Comparative Example 6), and subjected to the sliding durability test.

The results are shown in Table 4.

TABLE 4

| Example No. | Total number of revolution until film breakage |
|---|---|
| Example 7 | >200,000 |
| Comparative Example 6 | 2,000 |
| Example 8 | >200,000 |

As is clear from Table 4, the total number of revolution until film breakage is by far larger in Examples 7 and 8 than Comparative Example 6. Thus, the organic surface protective lubricating films of the present invention are excellent in the sliding durability and satisfy the required wear resistance as the surface protective layer sufficiently.

EXAMPLE 9

Comparative Examples 7 and 8

Figure 6:
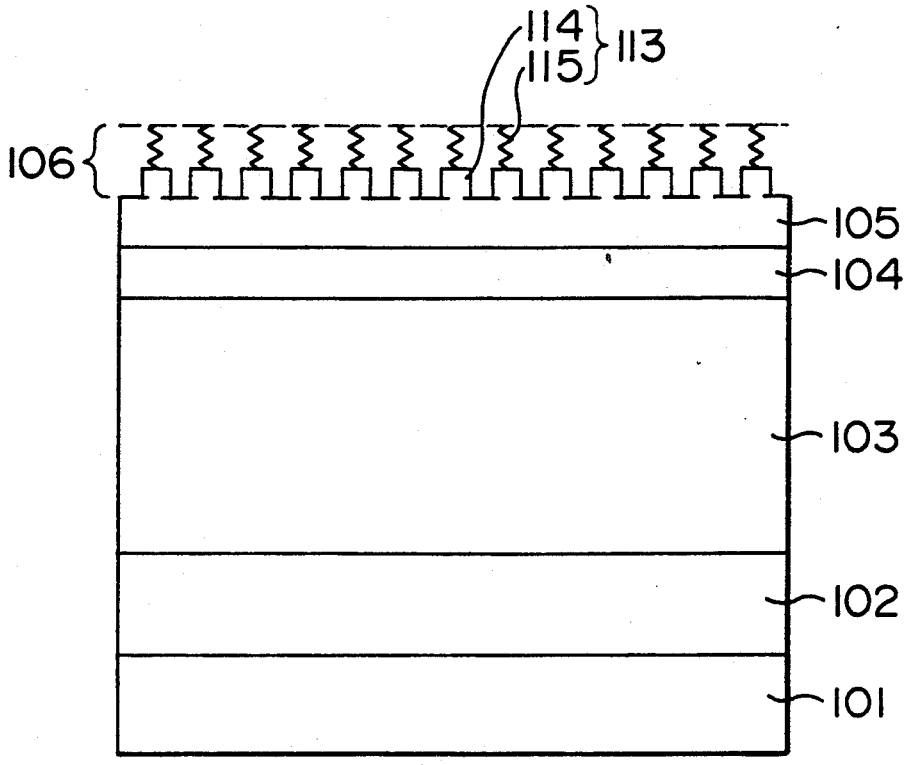
FIG. 6 is a cross-sectional view of an essential portion of one example of electrophotographic member of the present invention wherein a lubricating agent is directly fixed to a surface protective layer by chemical reaction.

An electrophotographic member as shown in FIG. 6 was produced. In FIG. 6, numeral 101 denotes an aluminum drum, numeral 102 a blocking layer, numeral 103 a carrier conductive layer, numeral 104 a carrier generation layer, numeral 105 a surface protective layer, numeral 106 a lubricating agent layer, numeral 113 a lubricating agent, numeral 114 a non-fluorine-containing group, and numeral 115 a perfluoropolyoxyalkyl group.

On the aluminum drum 101 of 120 mm in diameter and 400 mm in length, the blocking layer 102 of a—SiC:H:B using mixed gases of monosilane, ethylene, diborane and hydrogen; the carrier conductive layer 103 of a—Si:H:B using mixed gases of monosilane, diborane and hydrogen; the carrier generation layer 104 of a—SiGe:H using mixed gases of monosilane, germanium and hydrogen; and the surface protective layer 105 of a—SiC:H using mixed gases of monosilane, ethylene and hydrogen, were formed successively in the plasma gas phase reaction apparatus wherein high-frequency of 13.56 MHz was applied. Thicknesses of these layers were as follows: the blocking layer (102) 2 μm, the carrier conductive layer (103) 30 μm, the carrier generation layer (104) 1 μm, and the surface protective layer (105) 0.5 μm.

The resulting photosensitive element was taken out of the plasma gas phase reaction apparatus and subjected to coating of the lubricating agent layer 106. A coating solution was prepared by dissolving 10 g of a lubricating agent of the formula:

$$R_f—CONH—C_3H_6—Si(OC_2H_5)_3$$

wherein $R_f$ is $F[CF(CF_3)—CF_2O—]_n—CF(CF_3)—$; and n is 14 in average, in 990 g of flon solvent. In this coating solution, the above-mentioned photosensitive element was immersed to form a coating film on the surface. After heat treating at 150° C. for 1 hour in air to react the terminal silanol group in the non-fluorine-containing group 114 of the lubricating agent 113 with Si or C of the surface protective layer 105, the lubricating agent layer 106 covered with a plurality of perfluoropolyoxyalkyl groups 115 was prepared.

The thus obtained electrophotographic member was placed in the electrophotographic properties tester to carry out the corona charging test, while allowing the electrophotographic member to stand. The moisture resistance after the corona charging test was evaluated by the contact angle of water.

Figure 8:
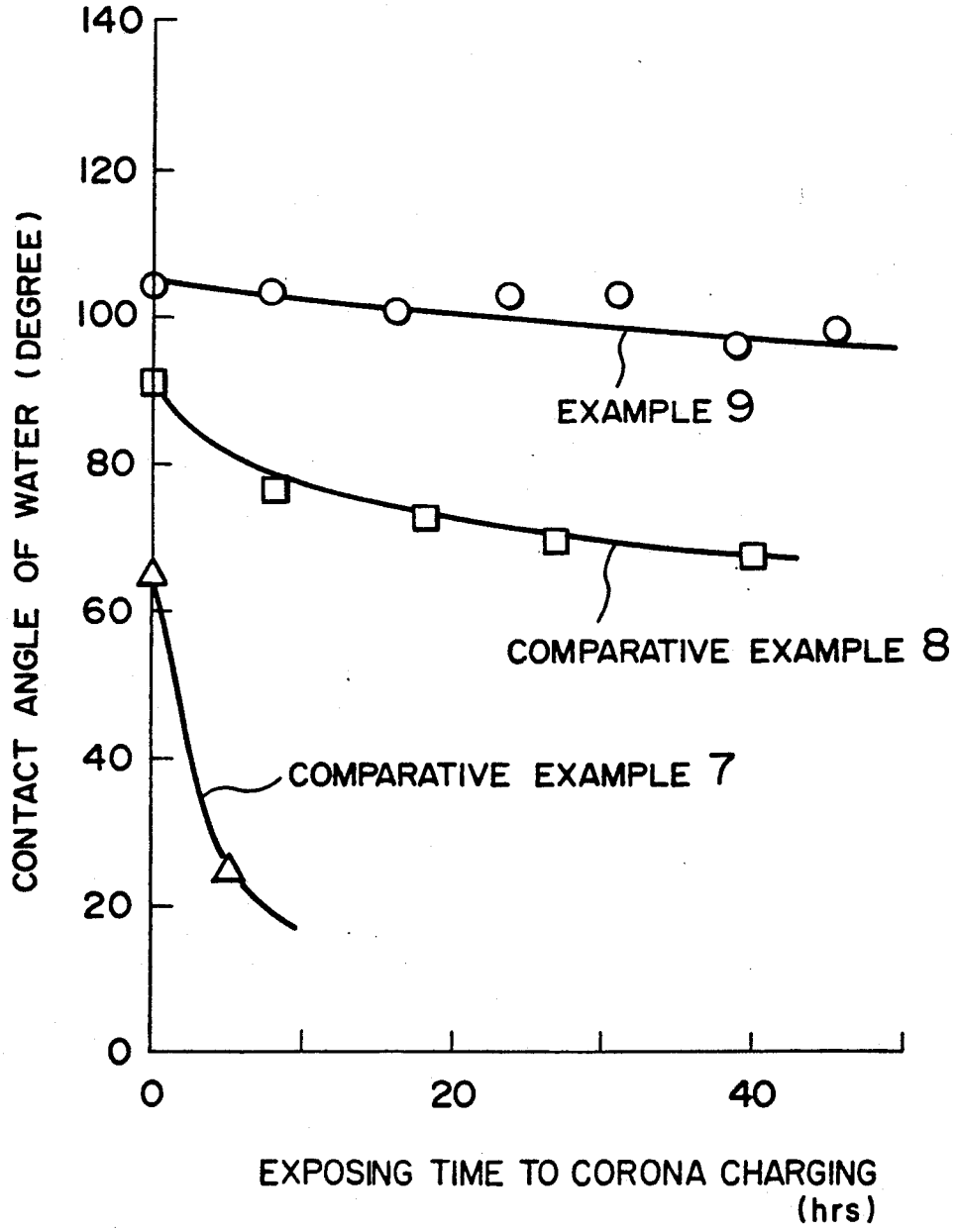
FIG. 8 is a graph showing a relationship between the exposure time to corona changing and the contact angle of water.

The results are shown in FIG. 8, which is a graph showing a relationship between the exposure time to corona charging (hours) and the contact angle of water (degree).

For comparison, the results of an electrophotographic member having no lubricating agent layer 106 (Comparative Example 7) are also shown in FIG. 8. Further, the results of an electrophotographic member obtained in the same manner as mentioned in Example 9 except for using as a lubricating agent a fluorine-containing compound of the formula:

$$C_8F_{17}CH_2CH_2Si(OCH_3)_3$$

(COMPARATIVE EXAMPLE 8) ARE ALSO SHOWN IN FIG. 8.

As shown in FIG. 8, the electrophotographic member of Example 9 shows good moisture resistance with high contact angle even after 40 hours' corona charging.

A printing test was carried out by mounting the electrophotographic member of Example 9 or Comparative Example 8 on a printer having a printing speed of 120 pages per minute using a semiconductor laser with wavelength of 780 nm as a light source.

As a result, in the case of the electrophotographic member of Example 9, even after printing 3,000,000 pages under conditions of humidity of 80% RH, clear images were obtained without causing problems of filming and image blurring. Further, when the resolution was measured by observing images using a microscope with low magnification, the image quality was not changed from the initial time.

In contrast, in the case of the electrophotographic member of Comparative Example 8, after printing 100,000 pages, filming took place, which resulted in causing a problem of obtaining no clear images.

Figure 9:
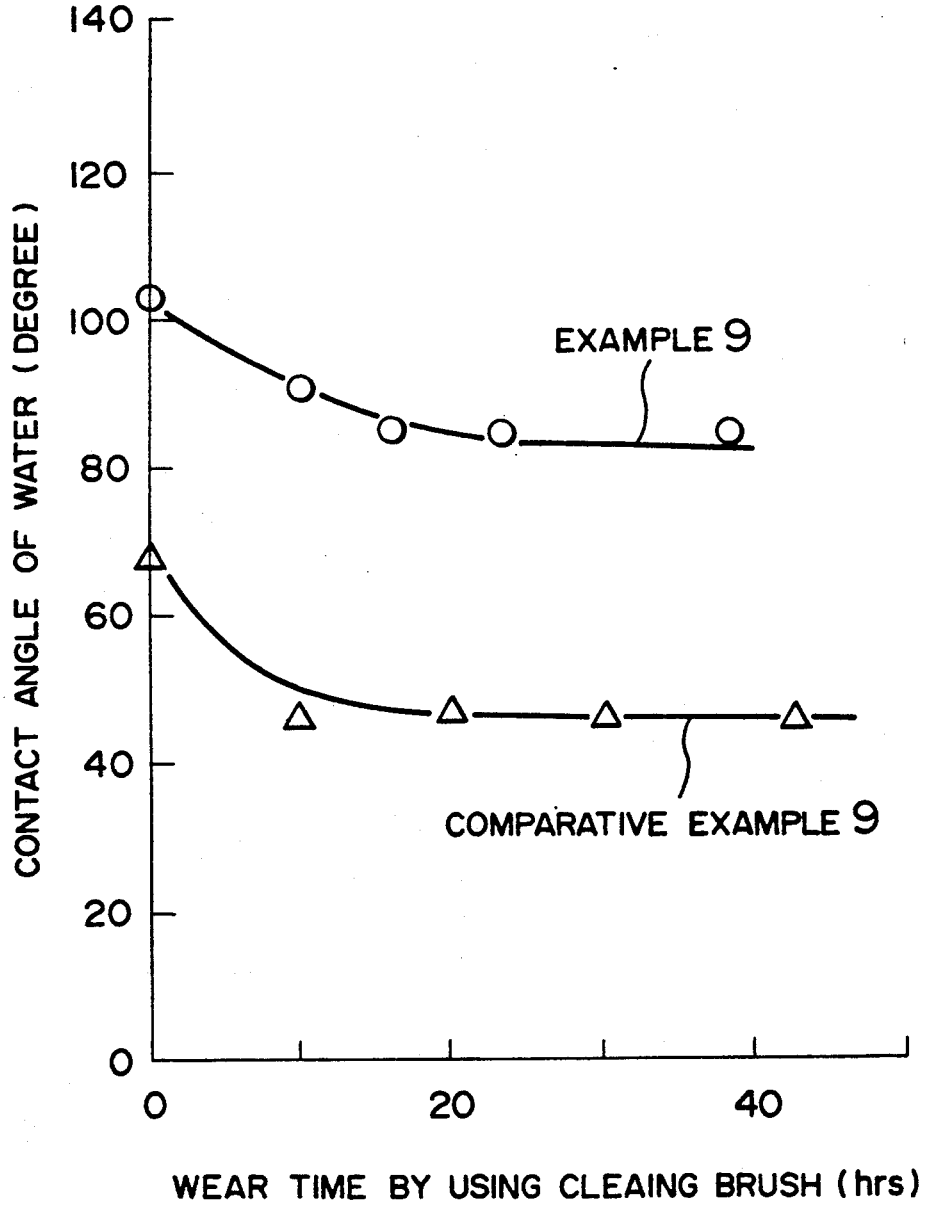
FIG. 9 is a graph showing a relationship between the wear time by using a cleaning brush and the contact angle of water.

On the other hand, the wear resistance by using cleaning brush was evaluated by the contact angle of water and shown in FIG. 9.

For comparison, the results of an electrophotographic member having no lubricating agent layer 106 (Comparative Example 9) are also shown in FIG. 9.

As is clear from FIG. 9, the electrophotographic member of Example 9 had high contact angle of water even after wearing time of 35 hours using cleaning brush and showed good wear resistance.

EXAMPLE 10

Figure 7:
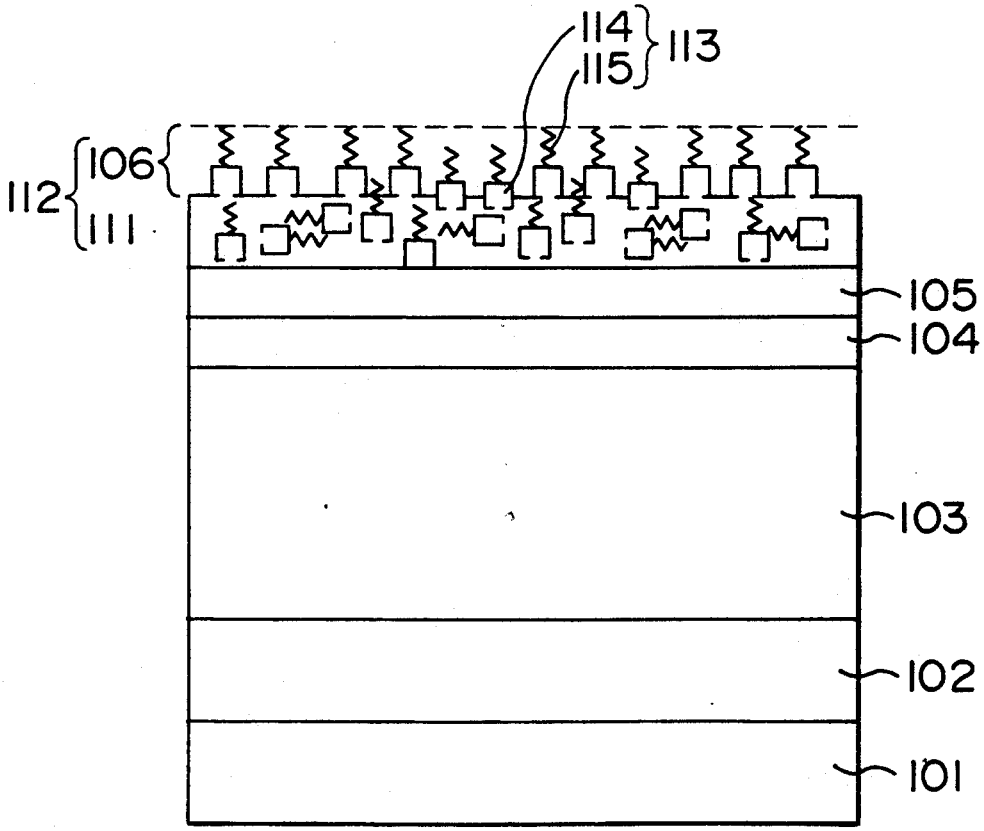
FIG. 7 is a cross-sectional view of an essential portion of one example of electrophotographic member of the present invention wherein a lubricating agent is included in an organic binder layer and fixed thereto by chemical reaction.

An electrophotographic member as shown in FIG. 7 was produced. That is, on the aluminum drum 101, films of 102 to 105 were formed in the same manner as described in Example 9 to provide an a—Si:H photoreceptor.

Then, the photoreceptor was taken out of the plasma gas phase reaction apparatus and subjected to coating of an organic surface protective layer 112 containing the lubricating agent 113. A coating solution was prepared as follows. Solution (1) was prepared by dissolving 5 g of the same lubricating agent as used in Example 9 in 995 g of flon solvent. Solution (2) was prepared by dissolving 59.5 g of an epoxy resin, 40.5 g of a phenol resin, and 0.6 g of triethylammonium tetraphenyl borate in a mixed solvent of 800 g of methyl ethyl ketone, and 100 g of acetate ethylene glycol mono-n-butyl ether. Then, Solution (1) and Solution (2) were mixed.

The photosensitive element was immersed in the above-mentioned mixed coating solution to form an organic surface protective layer 112 comprising an organic binder layer 111 and a lubricating layer 106. Then, the resulting photoreceptor was subjected to a first-step heat treatment at 100° C. for 1 hour, followed by a second-step heat treatment at 200° C. for 2 hours (curing of the binder with heating) to complete the formation of the organic surface protective layer 112. The lubricating agent 113 having the perfluoropolyoxyalkyl group 115 and the non-fluorine-containing group 114 with terminal silanol group was chemically bonded to the organic binder layer 111 and fixed in the organic binder layer 111 or on the surface of the organic binder layer 111.

The electrophotographic member of this Example had high contact angle of water as in the case of Example 9 and showed good moisture resistance.

Further, after printing 3,000,000 pages of paper under conditions of humidity of 80% RH, clear images were obtained without causing a problem of image blurring.

EXAMPLE 11

An a—Si:H photoreceptor with four layer structure was obtained in the same manner as described in Example 9.

A coating solution was prepared by dissolving 4 g of a lubricating agent of the formula:

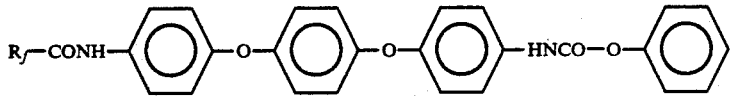

wherein $R_f$ is $F(CF(CF_3)—C_2F_2O)_n—\dot{C}F(CF_3)—$; and n is 14 in average, 37.9 g of an epoxy resin, 62.1 g of a phenol resin and 0.38 g of triethylammonium tetraphenyl borate as a curing accelerator for the epoxy resin in a mixed solvent of 1596 g of methyl ethyl ketone, 200 g of acetate ethylene glycol mono-n-butyl ether and 100 g of flon solvent.

The photoreceptor was immersed in the coating solution to form an organic surface protective layer containing epoxy resin on the surface. Then, the photoreceptor was subjected to a first-step heat treatment at 100° C. for 1 hour, followed by a second-step heat treatment at 200° C. for 2 hours (curing with heating) to complete the formation of the organic surface protective layer. Thus, the isocyanate group of the lubricating agent was chemically bonded to the epoxy group, resulting in fixing in the organic binder layer or on the surface of the organic binder layer.

The layer structure of Example 11 was the same as that of Example 10.

The resulting electrophotographic member had high contact angle of water as in the case of Example 9 and showed good moisture resistance.

Further, after printing 3,000,000 pages of paper under conditions of humidity of 80% RH, clear images were obtained without causing a problem of image blurring.

FIG. 10 is a schematic view of an electrophotographic apparatus using the electrophotographic member of the present invention.

In FIG. 10, numeral 501 denotes an a—Si:H photosensitive drum, numeral 502 a charger, numeral 503 an optical system, numeral 504 a developing device, numeral 506 a transfer device, numeral 507 a cleaner, numeral 508 a power source-circuit portion, numeral 509 a toner, numeral 511 a sheet of paper, numeral 512 a fade lamp, numeral 513 an erasing lamp, numeral 514 a preheater, numeral 516 a heat roll, and numeral 517 a laser light.

The photoreceptor drum 501 is charged by the charging device 502.

On the surface of the charged photoreceptor drum 501, the laser light 517 was irradiated to form a latent image on the photoreceptor drum 501.

The developing device 504 makes the toner 509 adhere to the latent image on the photoreceptor drum 501 to form a printing pattern.

The fade lamp 512 is provided to transfer the toner on the photoreceptor drum 501 effectively to the sheet of paper 511.

In the transfer device 506, the printing pattern on the photoreceptor drum is transferred to the sheet of paper 511.

The sheet of paper 511 on which the printing pattern is transferred passes the preheater 514 and the heat roll 516 to fix the toner.

On the other hand, the toner remaining on the photoreceptor drum 501 is removed by the erasing lamp 513 and the cleaner 507.

By using such an apparatus, it becomes possible to conduct printing without filming and image blurring.

As mentioned above, according to the present invention, there can be produced the electrophotographic member excellent in moisture resistance even after used repeatedly for a long period of time, as well as excellent in wear resistance and cleaning properties, and having a long life.

Further, by the electrophotographic apparatus using the electrophotographic member of the present invention, there can be obtained clear images without filming and image blurring.

What is claimed is:

1. An electrophotographic member comprising a support, a photoconductive layer made of a hydrogenated amorphous silicon-containing material formed on the support, and a surface layer formed on the photoconductive layer, said surface layer comprising a lubricating agent having a perfluoropolyoxyalkyl group or a perfluoropolyoxyalkylene group containing 20 or more carbon atoms to form an organic surface protective lubricating layer and a fixing group for fixing the surface layer to the photoconductive layer.

2. An electrophotographic member according to claim 1, wherein the surface layer also comprises an organic polymer binder layer and includes the lubricating agent having a perfluoropolyoxyalkyl group or a perfluoropolyoxyalkylene groups and a non-fluorine-containing groups as a fixing group, said perfluoropolyoxyalkyl or perfluoropolyoxyalkylene group being deposited and forming an organic surface protective lubricating layer on the surface of the binder layer, and said non-fluorine-containing group being fixed in the binder layer.

3. An electrophotographic member according to claim 2, wherein the total thickness of the organic surface protective lubricating layer and the binder layer is 0.01 to 1 μm.

4. An electrophotographic member according to claim 2, wherein the lubricating agent is a compound represented by the formula:

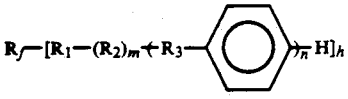

wherein $R_f$ is the perfluoropolyoxyalkyl group or the perfluoropolyoxyalkylene group; $R_1$ is a direct link, —$CH_2$—, —CO—, or —COHN—; $R_2$ is an oxyalkylene group having 2 or 3 carbon atoms; $R_3$ is a direct link, —O—, —COO—, —CONH—, —NHCO—, —$OC_pH_{2p}$— or —$C(CH_3)_2$—, $R_3$ being able to be different ones depending on repetition; m is zero or an integer of 1 or more; n is an integer of 1 or more; h is an integer of 1 or 2; and p is an integer of 1 or 2.

5. An electrophotographic member comprising an electroconductive support, a blocking layer formed thereon, a carrier conductive layer formed thereon, a carrier generation layer formed thereon, a protective layer for the carrier generation layer formed thereon, and an organic polymer binder layer formed thereon, said carrier conductive layer and said carrier generation layer being made of a hydrogenated amorphous silicon-containing material and forming together a photoconductive layer, and said binder layer including a lubricating agent having a perfluoropolyoxyalkyl group or a perfluoropolyoxyalkylene group containing 20 or more carbon atoms to form an organic surface protective lubricating layer on the surface of binder layer and a non-fluorine-containing group as a fixing group.

6. An electrophotographic member comprising an electroconductive support, a blocking layer formed thereon, a carrier generation and conductive layer formed thereon, a protective layer for said carrier generation and conductive layer formed thereon, and an organic polymer binder layer formed thereon, said carrier generation and conductive layer being made of a hydrogenated amorphous silicon-containing material and forming a photoconductive layer, and said binder layer including a lubricating agent having a perfluoropolyoxyalkyl group or a perfluoropolyoxyalkylene group containing 20 or more carbon atoms to form an organic surface protective lubricating layer on the surface of binder layer and a nonfluorine-containing group as a fixing group.

7. An electrophotographic member according to claim 5, wherein the organic polymer binder layer is directly formed on the carrier generation layer without forming the protecting layer.

8. An electrophotographic member according to claim 6, wherein the organic polymer binder layer is directly formed on the carrier generation and conductive layer without forming the protective layer.

9. A process for producing an electrophotographic member, which comprises forming a photoconductive layer on a support using a hydrogenated amorphous silicon-containing material, forming an organic polymer binder layer comprising an organic polymer binder and a lubricating agent having a perfluoropolyoxyalkyl group or a perfluoropolyoxyalkylene group containing 20 or more carbon atoms and a non-fluorine-containing group as a fixing group, and heat treating the binder layer to deposit the perfluoropolyoxyalkyl group or the perfluoropolyoxyalkylene group on the surface of the binder layer.

10. An electrophotographic member according to claim 1, wherein the surface layer is an organic polymer binder layer and subjected to a plasma fluorinating treatment.

11. An electrophotographic member according to claim 5, wherein the organic polymer binder layer has been subjected to a plasma fluorinating treatment.

12. An electrophotographic member according to claim 6, wherein the organic polymer binder layer has been subjected to a plasma fluorinating treatment.

13. A process for producing an electrophotographic member, which comprises forming a photoconductive layer on a support using a hydrogenated amorphous silicon-containing material, coating a mixture comprising a lubricating agent having a perfluoropolyoxyalkyl group or a perfluoropolyoxyalkylene group containing 20 or more carbon atoms and a non-fluorine containing group as a fixing group, and an organic polymer binder on the photoconductive layer, heat treating the coated mixture to form an organic surface protective layer, and subjecting the organic surface protective layer to a plasma fluorinating treatment.

14. An electrophotographic member comprising a support, and formed thereon a photoconductive layer made of a hydrogenated amorphous silicon-containing material, the upper most surface portion of the electrophotographic member having a lubricating agent of the formula:

$$R_f[R_4—R_5—Si(R_6)_q]_u$$

wherein $R_f$ is a perfluoropolyoxyalkyl group or a perfluoropolyoxyalkylene group containing 20 or more carbon atoms; $R_4$ is —CONH—, —COO—, or —$CH_2O$—; $R_5$ is an alkylene group having 2 to 4 carbon atoms; $R_6$ is an oxyalkyl group having 1 to 3 carbon atoms; q is an integer of 1 to 3 and u is an integer of 1 to 2.

15. An electrophotographic member comprising a support and formed thereon a photoconductive layer made of a hydrogenated amorphous silicon-containing material, the uppermost surface portion of the photoconductive layer having a lubricating agent having a perfluoropolyoxyalkyl group or a perfluoropolyoxyalkylene group containing 20 or more carbon atoms and a non-fluorine-containing group with a terminal silanol group.

16. An electrophotographic member comprising a support, a photoconductive layer formed on the support, and an organic surface protective layer formed on the photoconductive layer, said organic surface protective layer containing a lubricating agent of the formula:

$$Rf\text{-}[R_4\text{—}R_5\text{—}Si(R_6)q]_u$$

wherein $R_f$ is a perfluoropolyoxyalkyl group or a perfluoropolyoxylalkylene group containing 20 or more carbon atoms; $R_4$ is —CONH—, —COO—, or —$CH_2O$—; $R_5$ is an alkylene group having 2 to 4 carbon atoms; $R_6$ is an oxyalkyl group having 1 to 3 carbon atoms; q is an integer of 1 to 3 and u is an integer of 1 or 2.

17. An electrophotographic member comprising a support, a photoconductive layer formed on the support, and an organic surface protective layer formed on the photoconductive layer, said organic surface protective layer containing a lubricating agent having a perfluoropolyoxyalkyl group or a perfluoropolyoxyalkylene group containing 20 or more carbon atoms and a non-fluorine-containing group with a terminal silanol group, a part of the perfluoropolyoxyalkyl group or perfluoropolyoxylalkylene group being present on the surface of the organic surface protective layer.

18. An electrophotographic member comprising a support, and formed thereon a photoconductive layer, the uppermost surface portion of the photoconductive layer having a lubricating of the formula:

$$Rf\text{-}[R_4\text{—}R_5\text{—}Si(R_6)q]_u$$

wherein $R_f$ is a perfluoropolyoxyalkyl group or a perfluoropolyoxyalkylene group containing 20 or more carbon atoms; $R_4$ is —CONH—, —COO—, or —$CH_2O$—; $R_5$ is an alkylene group having 2 to 4 carbon atoms; $R_6$ is an oxyalkyl group having 1 to 3 carbon atoms; q is an integer of 1 to 3 and u is an integer of 1 or 2, said lubricating agent being covered with an organic surface substance and a part of said lubricating agent being present on the organic surface substance.

19. In an electrophotographic member comprising a support and formed thereon a photoconductive layer made of a hydrogenated amorphous silicon-containing silicon material, the improvement wherein an organic surface protective layer comprising an epoxy resin and a lubricating agent having a perfluoropolyoxyalkyl group or a perfluoropolyoxyalkylene group containing 20 or more carbon atoms and a fixing group with an isocyanate group is formed on the uppermost surface portion of the photoconductive layer.

20. An electrophotographic member according to claim 19, wherein the lubricating agent is represented by the formula:

$$R_f\text{—}R\text{—}(R')_j\text{—}(NCO)_k, \text{ or}$$

$$\{R_f\}\text{—}\{R\text{—}(R')_j\text{—}(NCO)_k\}_2$$

wherein $R_f$ is the perfluoropolyoxyalkyl group or the perfluoropolyoxyalkylene group; R is —CONH—, —OCONH— or —$CH_2OCONH$—; R' is a divalent or trivalent saturated aliphatic hydrocarbon group or aromatic hydrocarbon group; j is zero or an integer of 1 or more; and k is an integer of 1 or 2.

21. An electrophotographic member according to claim 19, wherein the lubricating agent is represented by the formula:

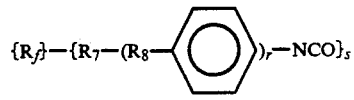

wherein $R_f$ is the perfluoropolyoxyalkyl group or the perfluoropolyoxyalkylene group; $R_7$ is a direct link, an amido linkage, —$CH_2$—, or —CO—; $R_8$ is a direct link, an ether linkage, an ester linkage, an amido linkage or —$OC_kH_{2k}$—, $R_8$ being different ones depending on repetition; r is an integer of 1 or more; s is an integer of 1 or 2; and k is an integer of 1 or 2.

22. An electrophotographic member according to claim 19, wherein the isocyanate group is masked with a phenol.

23. An electrophotographic apparatus comprising a photoreceptor drum comprising a support and formed thereon a photoconductive layer made of a hydrogenated amorphous silicon-containing material, a charging system for charging said photoreceptor drum, an optical system for forming a latent image on said photoreceptor drum, a developing system for forming a printing pattern by adhering a toner to said photoreceptor drum forming the latent image, an image transferring system for transferring the printing pattern on said photoreceptor drum, and a cleaning system for removing excess toner remaining on said photoreceptor drum, the uppermost surface portion of said photoreceptor drum comprising a lubricating agent having a perfluoropolyoxyalkyl group or a perfluoropolyoxyalkylene group containing 20 or more carbon atoms to form an organic surface protective layer and a fixing group for fixing the lubricating agent to the surface portion.

24. An electrophotographic apparatus according to claim 23, wherein the lubricating agent is a compound represented by the formula:

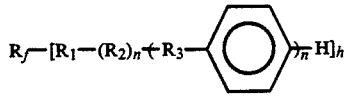

wherein $R_f$ is the perfluoropolyoxyalkyl group or the perfluoropolyoxyalkylene group; $R_1$ is a direct link, —$CH_2$—, —CO—, or —CONH—; $R_2$ is an oxyalkylene group having 2 or 3 carbon atoms; $R_3$ is a direct link, —O—, —COO—, —CONH—, —NHCO—, —$OC_pH_{2p}$— or —$C(CH_3)_2$—, $R_3$ being able to be different ones depending on repetition; m is zero or an integer of 1 or more; n is an integer of 1 or more; h is an integer of 1 or 2; and p is an integer of 1 or 2.

25. An electrophotographic apparatus according to claim 23, wherein the lubricating agent is a compound represented by the formula:

$$Rf\{R_4—R_5—Si(R_6)_q]_u$$

wherein $R_f$ is a perfluoropolyoxyalkyl group or a perfluoropolyoxyalkylene group; $R_4$ is —CONH—, —COO—, or —$CH_2O$—; $R_5$ is an alkylene group having 2 to 4 carbon atoms; $R_6$ is an oxyalkyl group having 1 to 3 carbon atoms; q is an integer of 1 to 3 and u is an integer of 1 to 2.

26. An electrophotographic apparatus according to claim 23, wherein the uppermost surface portion of said photoreceptor drum comprising an epoxy resin and a lubricating agent of the formula:

$R_f—R—(R')_j—(NCO)_k$, or $$\{R_f\}—\{R—(R')_j—(NCO)_k\}_2$$

wherein $R_f$ is the perfluoropolyoxyalkyl group or the perfluoropolyoxyalkylene group; R is —CONH—, —OCONH— or —$CH_2OCONH$—; R' is a divalent or trivalent saturated aliphatic hydrocarbon group or aromatic hydrocarbon group; j is zero or an integer of 1 or more; and k is an integer of 1 or 2, or

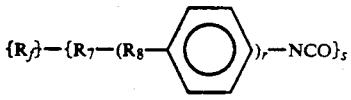

wherein $R_f$ is the perfluoropolyoxyalkyl group or the perfluoropolyoxyalkylene group; $R_7$ is a direct link, an amido linkage, —$CH_2$— or —CO—; $R_8$ is a direct link, an ether linkage, an ester linkage, an amido linkage or —$OC_kH_{2k}$—, $R_8$ being different ones depending on repetition; r is an integer of 1 or more; s is an integer of 1 or 2; and k is an integer of 1 or 2.

27. An electrophotographic member according to claim 1, wherein the fixing group is a non-fluorine-containing group and is reactive with the photoconductive layer.

28. An electrophotographic member according to claim 2, wherein the fixing group is a non-fluorine-containing group that is non-reactive and that is fixed to the binder layer.

29. A process for producing an electrophotographic member, which comprises forming a photoconductive layer on a support using a hydrogenated amorphous silicon-containing material, attaching to a surface of said photoconductive layer a lubricating agent of the formula:

$$Rf[R_4—R_5—Si(R_6)_q]_u$$

wherein $R_f$ is a perfluoropolyoxyalky group or a perfluoropolyoxyalkylene group containing 20 or more carbon atoms; $R_4$ is —CONH—, —COO—, or —$CH_2O$—; $R_5$ is an alkylene group having 2 to 4 carbon atoms; $R_6$ is an oxyalkyl group having 1 to 3 carbon atoms; q is an integer of 1 to 3 and $u$ is an integer of 1 or 2.

* * * * *